US008615899B2

(12) United States Patent
Rocheleau

(10) Patent No.: US 8,615,899 B2
(45) Date of Patent: Dec. 31, 2013

(54) PAIRED AIR BAR/HOLE BAR ARRANGEMENT IN WEB DRYER

(75) Inventor: Michael O. Rocheleau, DePere, WI (US)

(73) Assignee: MegTec Systems, Inc., DePere, WI (US)

( * ) Notice: Subject to any disclaimer, the term of this patent is extended or adjusted under 35 U.S.C. 154(b) by 553 days.

(21) Appl. No.: 12/462,359

(22) Filed: Aug. 3, 2009

(65) Prior Publication Data

US 2010/0050468 A1 Mar. 4, 2010

Related U.S. Application Data

(60) Provisional application No. 61/190,283, filed on Aug. 27, 2008.

(51) Int. Cl.
*F26B 13/10* (2006.01)

(52) U.S. Cl.
USPC ..... 34/638; 34/641; 34/643; 34/654; 34/461; 34/464

(58) Field of Classification Search
USPC ..... 34/460, 461, 464, 638, 639, 640, 641, 34/643, 654
See application file for complete search history.

(56) References Cited

U.S. PATENT DOCUMENTS

| | | | | | |
|---|---|---|---|---|---|
| 3,231,165 | A * | 1/1966 | Wallin et al. | 242/615.11 |
| 3,549,070 | A * | 12/1970 | Frost et al. | 34/448 |
| 4,785,986 | A * | 11/1988 | Daane et al. | 34/654 |
| 4,901,449 | A | 2/1990 | Wimberger | 34/156 |
| 5,471,766 | A * | 12/1995 | Heikkila et al. | 34/461 |
| 5,555,635 | A * | 9/1996 | Seidl | 34/79 |
| 5,590,480 | A | 1/1997 | Bria et al. | 34/629 |
| 5,647,144 | A | 7/1997 | Bria et al. | 34/414 |
| 5,749,164 | A * | 5/1998 | Bowden | 34/641 |
| 6,289,607 | B1 * | 9/2001 | Aaltonen et al. | 34/508 |

* cited by examiner

*Primary Examiner* — Jiping Lu
(74) *Attorney, Agent, or Firm* — Nields, Lemack & Frame, LLC

(57) ABSTRACT

Apparatus and method for the non-contact drying of a web of material. The apparatus includes air flotation nozzles for floating the web, and direct air impingement nozzles for enhanced drying of the web. The nozzle arrangement is particularly well-suited to float and dry light weight webs under moderate to high tension. Increased cushion pressure is created to support the web preferably with the same horsepower as conventional arrangements. The increased cushion pressure pad of the nozzle arrangement allows for good flotation with reduced velocities below about 11,500 FPM. Machine direction wrinkles are removed and the result is positive flotation with no marking on the web or ink build up on the air bars. The nozzle arrangement includes pairs of flotation nozzles directly opposing pairs of direct impingement nozzles. A perforated member can be positioned between flotation nozzles within a pair of flotation nozzles to control return air.

11 Claims, 10 Drawing Sheets

PAIRED AIR BAR/HOLE BAR ARRANGEMENT IN WEB DRYER

This application claims priority of U.S. Provisional Application Ser. No. 61/190,283 filed on Aug. 27, 2008, the disclosure of which is incorporated herein by reference.

BACKGROUND OF THE INVENTION

In drying a moving web of material, such as paper, film or other sheet material, it is often desirable to contactlessly support the web during the drying operation in order to avoid damage to the web itself or to any ink or coating on the web surface. A conventional arrangement for contactlessly supporting and drying a moving web includes upper and lower sets of air bars extending along a substantially horizontal stretch of the web. Heated air issuing from the air bars floatingly supports the web and expedites web drying. The air bar array is typically inside a dryer housing which can be maintained at a slightly sub-atmospheric pressure by an exhaust blower that draws off the volatiles emanating from the web as a result of the drying of the ink thereon, for example.

When floating light weight webs under medium to high tensions, machine direction corrugations often form in the web which can not be removed with prior art dryer nozzle arrangements. In addition, these hard-to-float light weight webs tend to have ink build up and marking problems when conventional nozzle arrangements are employed.

It therefore would be desirable to provide a flotation dryer having a nozzle arrangement that provides excellent web flotation, excellent drying and heat transfer performance, minimal or no web flutter, and minimal or no corrugation formation even in light weight webs.

SUMMARY OF THE INVENTION

The problems of the prior art have been solved by the embodiments disclosed herein, which provide an apparatus and process for the non-contact drying of a web of material. The apparatus includes air flotation nozzles for floating the web, and direct air impingement nozzles for enhanced drying of the web. Specifically, a plurality of air flotation nozzles or air bars are mounted in one or more sections of a dryer enclosure in air-receiving communication with headers, preferably both above and below the web for the contactless convection drying of the web. In conjunction with these air flotation nozzles, one or more sections of the dryer also includes direct impingement nozzles such as hole-array bars or slot bars. The drying surface of the web is thus heated by both air issuing from the air flotation nozzles and from the direct impingement nozzles. As a result, the dryer has a high rate of drying in a small, enclosed space while maintaining a comfortable working environment. The nozzle arrangement includes pairs of flotation nozzles directly opposing pairs of direct impingement nozzles. A perforated member can be positioned between flotation nozzles within a pair of flotation nozzles to control return air.

The paired nozzle arrangement is particularly well-suited to float and dry light weight webs under moderate to high tension. Increased cushion pressure is created to support the web preferably with the same horsepower as conventional arrangements. The increased cushion pressure pad of the nozzle arrangement allows for good flotation with reduced velocities below about 11,500 FPM. Machine direction wrinkles are removed and the result is positive flotation with no marking on the web or ink build up on the air bars.

In its method aspects, embodiments include providing a web dryer enclosure having a web inlet slot and a web outlet slot, floatingly guiding a running web in the dryer enclosure with first and second opposed arrays of nozzles for floatingly supporting and drying the web, each array comprising at least a pair of air flotation nozzles and at least a pair of direct impingement nozzles, the pair of direct impingement nozzles opposing the pair of flotation nozzles, and wherein between each flotation nozzle with the pair of flotation nozzles, providing a member having a plurality of apertures for directing return air from said flotation nozzles.

DETAILED DESCRIPTION OF THE INVENTION

Although the present invention is not limited to any particular flotation nozzle design, it is preferred that flotation nozzles which exhibit the Coanda effect such as the HI-FLOAT® air bar commercially available from Megtec, Inc. can be used, in view of their high heat transfer and excellent flotation characteristics. Standard 1× HI-FLOAT® air bars are characterized by a spacing between slots of 2.5 inches; a slot width of 0.070 to 0.075 inches, usually 0.0725 inches; an installed pitch of 10 inches; and a web-to-air bar clearance of ⅛ inch. Air bar size can be larger or smaller. For example, air bars ½, 1.5, 2 and 4 times the standard size can be used. Air bars 2 times the standard size are characterized by a slot distance of 5 inches and slot widths of 0.140 to 0.145 inches (available commercially as "2× air bars" from Megtec, Inc.). In general, the greater distance between the slots results in a larger air pressure pad between the air bar and the web, which allows for increasing the air bar spacing. Another suitable flotation nozzle that can be used in the present invention is the Tri-Flotation air bar disclosed in U.S. Pat. No. 4,901,449, the disclosure of which is hereby incorporated by reference.

Means for creating direct air impingement on the web, such as a direct impingement nozzle having a plurality of apertures, such as a hole-array bar or slot bar, provides a higher heat transfer coefficient for a given air volume and nozzle velocity than a flotation nozzle. As between the hole-array bar and the slot bar, the former provides a higher heat transfer coefficient for a given air volume at equal nozzle velocities.

Although maximum heat transfer is obviously a goal of any dryer system, other considerations such as air volume, nozzle velocity, air horsepower, proper web flotation, dryer size, web line speed, etc., influence the extent to which optimum heat transfer can be achieved, and thus the appropriate design of the direct impingement nozzle.

Figure 1:
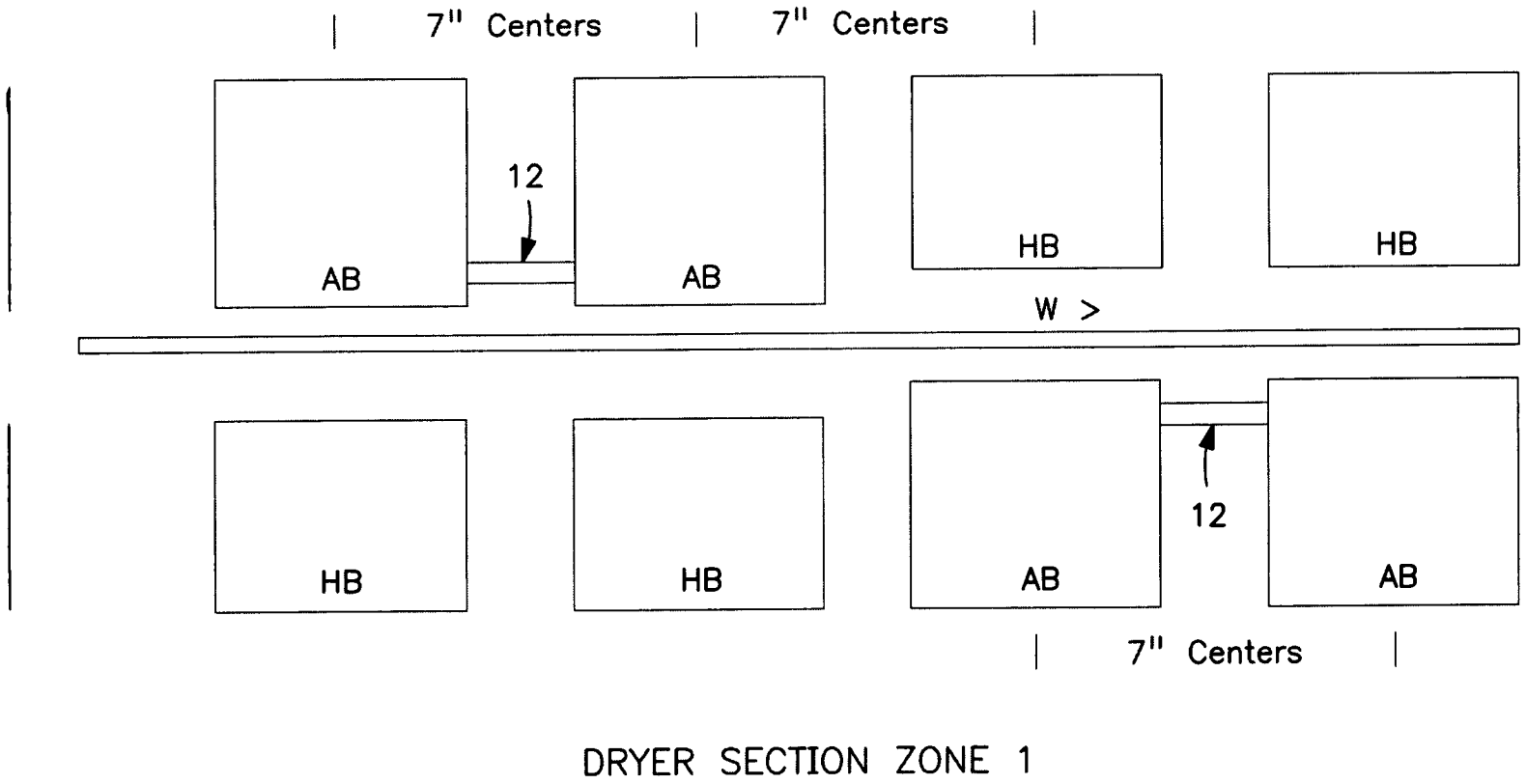
FIG. 1 is a schematic view of a flotation nozzle/direct impingement nozzle arrangement in accordance with certain embodiments.

Turning now to FIG. 1, there is shown schematically a preferred flotation nozzle/direct impingement nozzle arrangement, such as for use in the first section (following the entry section) of a flotation dryer, with flotation nozzles or air bars denoted "AB" and direct impingement nozzles or hole bars denoted "HB". Horizontal web W is shown floatingly supported between upper and lower flotation nozzle/direct impingement nozzle arrays. Two flotation nozzles AB are preferably positioned on 7" centers with two direct impingement hole bars opposing them. Between the flotation nozzles is a member 42, preferably made of metal, with return air holes in it. This member creates an additional pressure pad area and when in combination with the two Coanda air bar pressure pads doubles the support force on the web and gives good flotation particularly to hard-to-float webs. In certain embodiments, in the nozzle array above the web, the pair of flotation nozzles AB, AB is followed by, in the web direction, a pair of direct impingement nozzles HB, HB, which in turn is followed by another pair of flotation nozzles, and so on. A similar arrangement is provided in the nozzle array below the web, provided that each pair of flotation nozzles above the web is opposed by a pair of direct impingement nozzles below the web. Preferably the opposing nozzles are directly opposed, as shown, rather than positioned in a staggered relationship.

The member 42 between each flotation nozzle in a given pair of flotation nozzles opposed by a pair of direct impingement nozzles functions to restrict and control the amount of return air creating an additional pressure pad area which in turn enhances the pressure pad of the two flotation nozzles AB, AB. With the increased pressure pad area, good flotation of previously hard-to-float webs is achievable. The increased pressure pad area eliminates the ink build up and web marking found in conventional arrangements when floating light weight, wet webs under higher tensions. The controlled return air allows for improved flotation without adding air horsepower requirements from larger supply fans.

Figure 5:
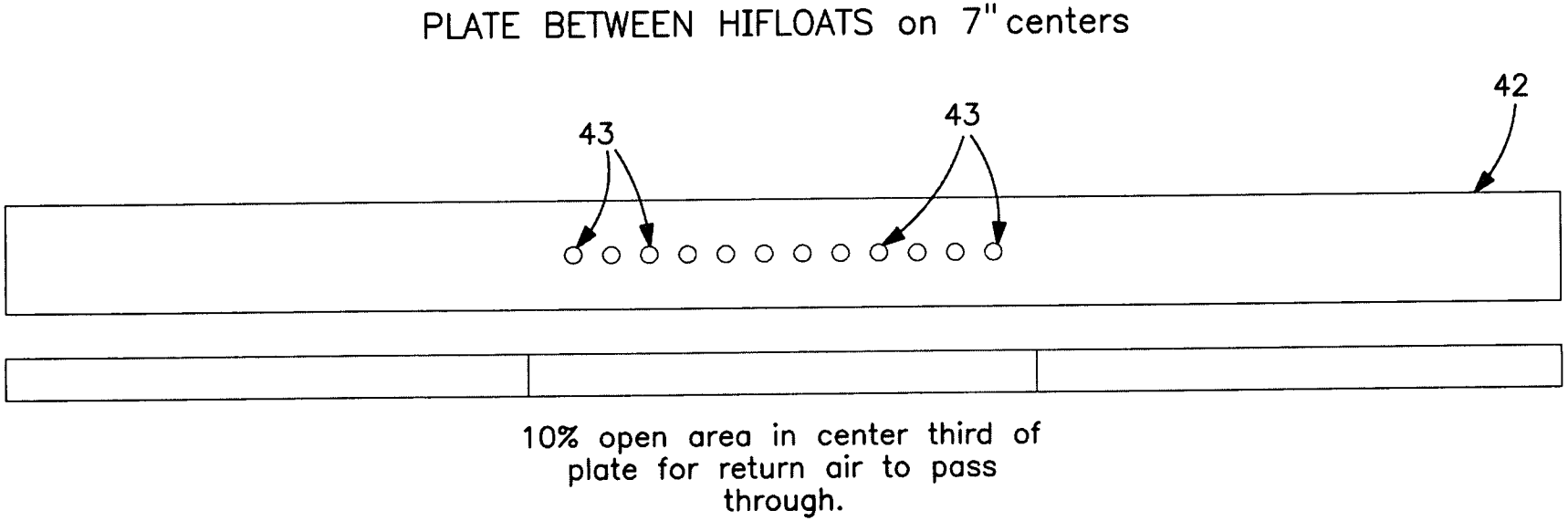
FIG. 5 is a top view of a return air member in accordance with certain embodiments.
Figure 10:
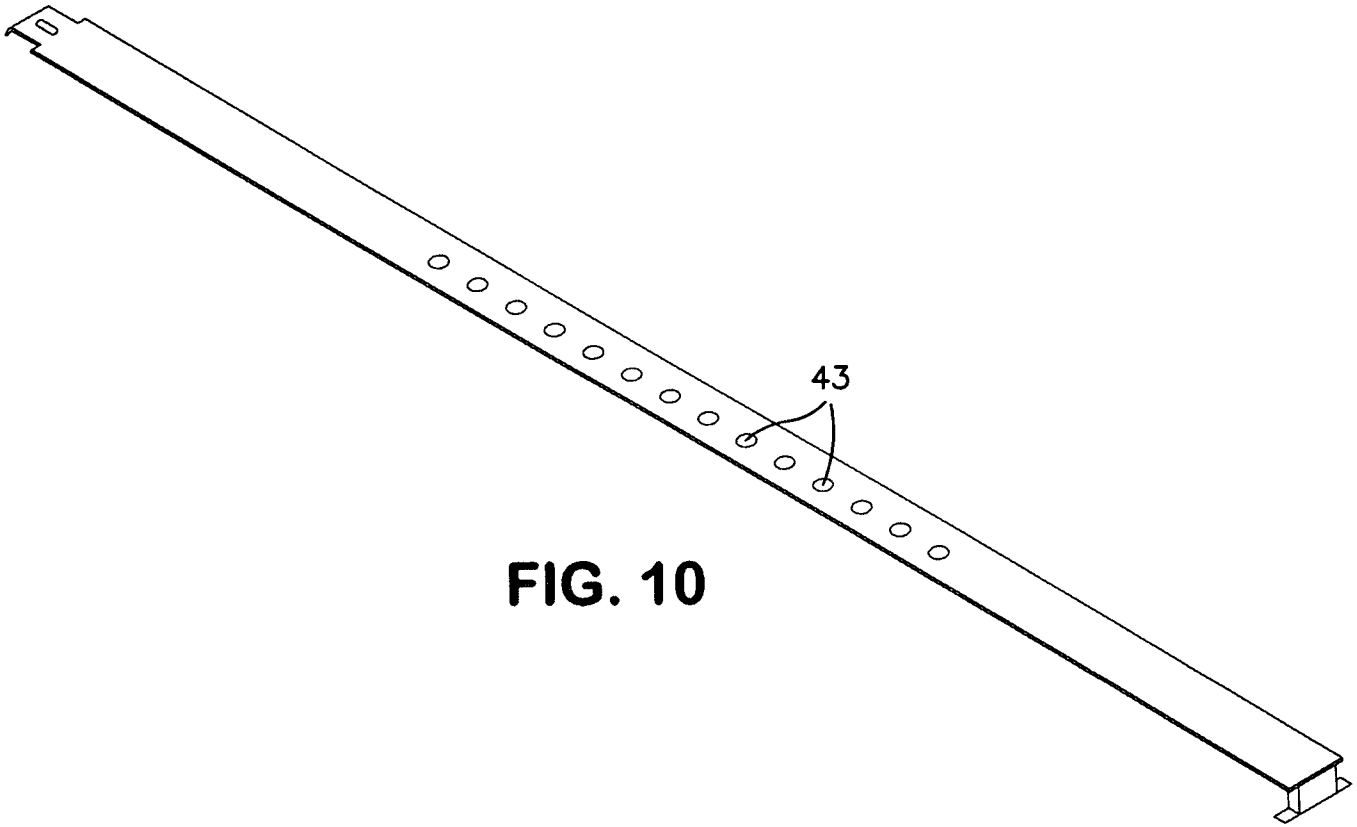
FIG. 10 is a perspective view of the apertured portion of a return air member in accordance with certain embodiments.
Figure 11:
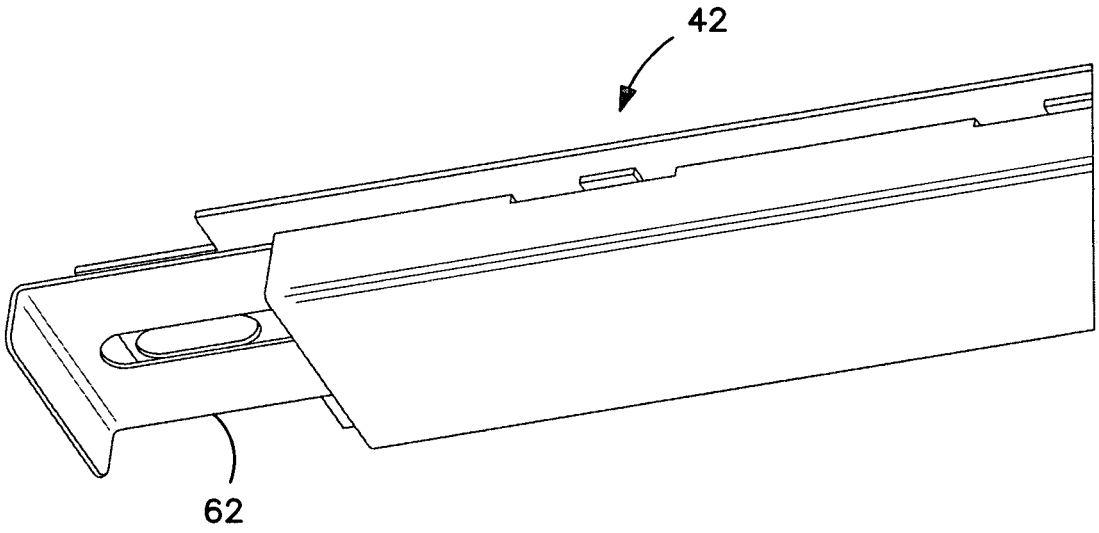
FIG. 11 is a perspective view of a return air member in accordance with certain embodiments.

The member 42 is mounted between the air bars to control the amount of air that leaves the two flotation nozzles AB, AB and becomes trapped between the web W, the member 42 and the face of each air bar AB. As can be seen in FIGS. 5, 10 and 11, the member 42 between the two flotation airs bars AB is preferably an elongated, flat plate, and has a calculated hole pattern in the center third of the plate 42 to meter the correct amount of air leaving the pressure pad area above the plate. The pressure pad area over the member 42 and the two adjacent Hifloat pressure pads in this arrangement create a cushion pressure to float a web that is over twice the strength of the cushion pressure pad of the flotation nozzles in certain conventional nozzle arrangements. The opposing grouped direct impingement bars HB, HB on 7" centers allow for increased heat transfer and form return air openings between the direct impingement bars to remove the solvent air via the dryer exhaust. The increased cushion pressure pad area developed from this arrangement eliminates the web marking and ink build up on air bars when floating high tensioned hard-to-float webs. The increased cushion pressure pad area of this arrangement allows for good flotation with reduced velocities below about 11,500 FPM required for prior art arrangements. Those skilled in the art will appreciate that the term "plate" as used herein is not to be construed as limiting the return air member 42 to any particular thickness or shape; although a flat planar sheet is preferred, other designs are within the scope of the present disclosure.

Figure 7:
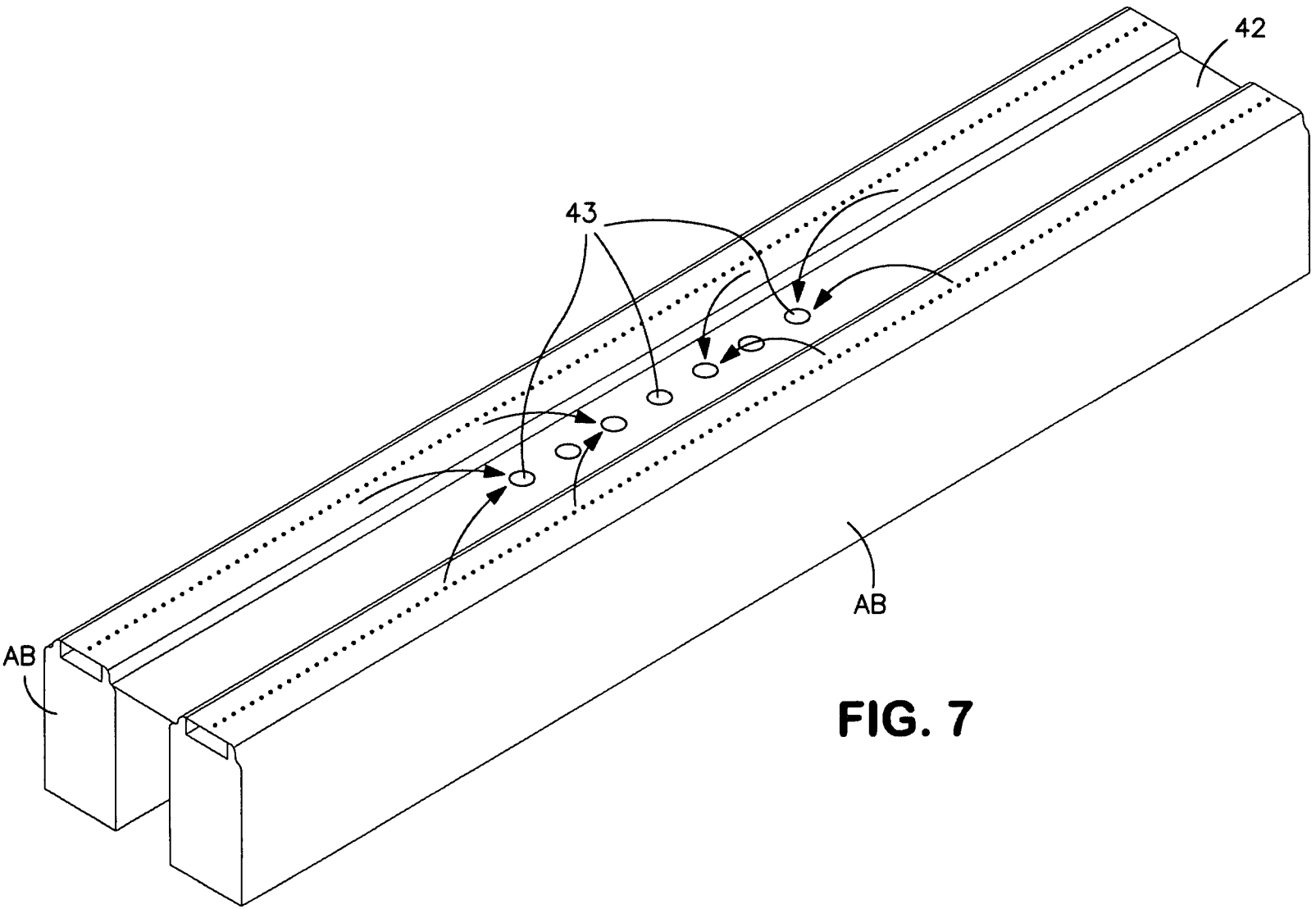
FIG. 7 is a perspective view of a paired nozzle arrangement with a return air member.

FIG. 5 shows an embodiment of member 42 suitable for use with the flotation bars AB. The member 42 is preferably a flat sheet having a length that corresponds to the length of the flotation bars AB. A portion of the member 42 includes a plurality of spaced apertures 43, which are preferably located in the center third of the plate in the cross-machine direction, aligned linearly and centrally in the member 42 in the machine direction. In the embodiment shown, there are twelve such apertures 43, although the number and size of the apertures is not particularly limited, and depends upon the desired return air characteristics to be achieved (note the embodiment of FIG. 10 includes 14 circular apertures). One suitable configuration has 1" diameter circular apertures, at 2.5" centers. Other shaped apertures could be used. An open area of about 10% is preferred. FIG. 7 shows the member 42 mounted between each flotation nozzle AB in a paired flotation nozzle assembly. The arrows illustrate one possible direction of return air flow through the apertures in the member 42.

Figure 8:
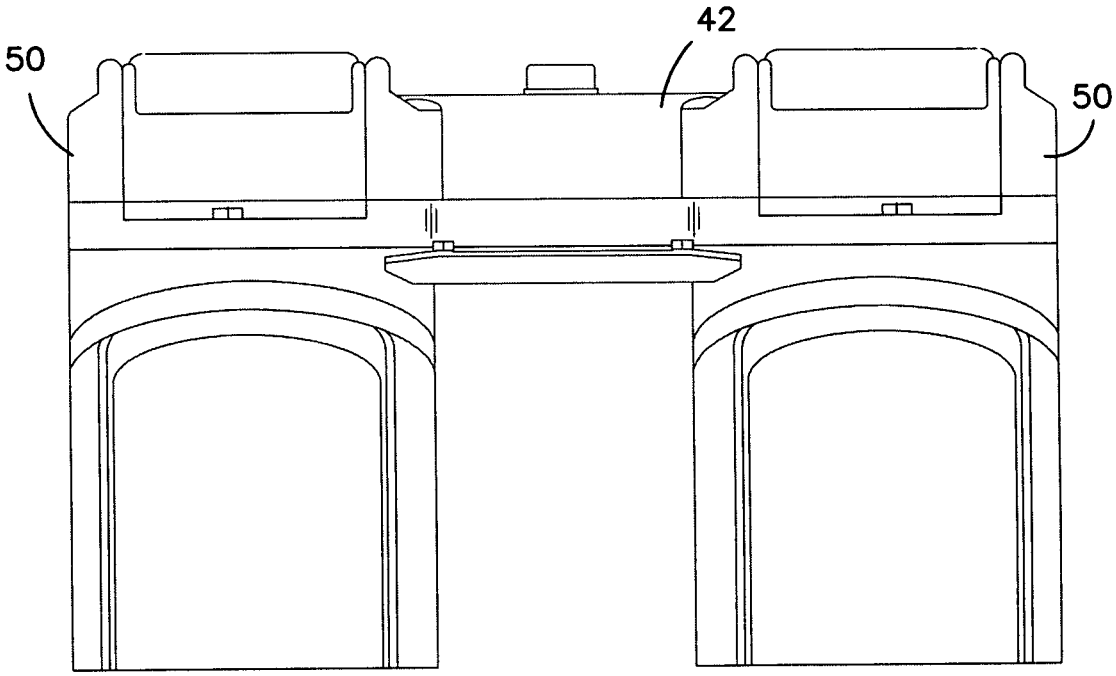
FIG. 8 is a perspective view of a dryer-gear side arrangement of a paired nozzle and return air member.
Figure 9:
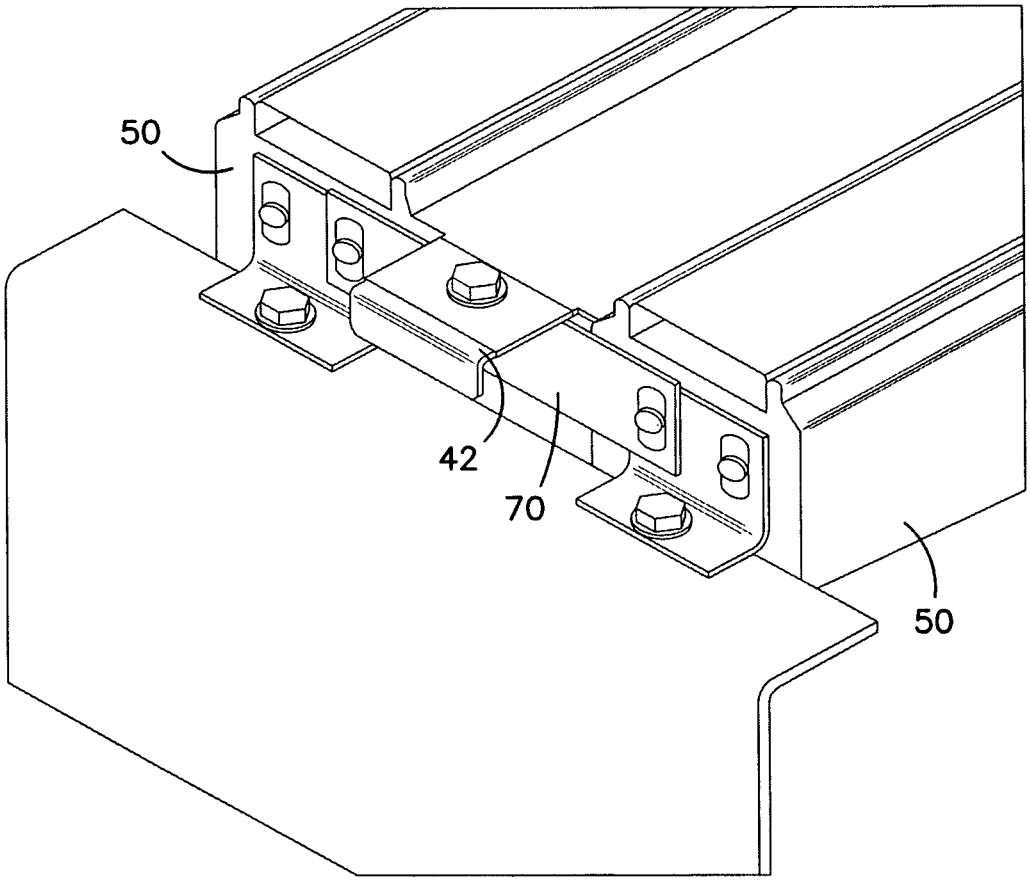
FIG. 9 is a perspective view of an operator-side arrangement of a paired nozzle and return air member.

FIGS. 8 and 9 illustrate a suitable dryer gear-side and operator-side attachment of the member 42 to the paired air flotation bars 50. The gear-side hold down tabs of member slide under the air bar 50 bodies to secure that end of member 42. The operator-side hold down 70 includes a flat plate for affixing it to the air bar bodies, and an apertured right angle flange that positions under the member for inclusion of an adjustment bolt to adjust the open to flow area in the member 42 and balance the return air while on the run. The member is thus a damper in that the 1" holes can be made to cover or overlap with the adjustment of the sliding bottom plate 62, also shown in FIG. 11. The bottom plate 62 and the plate 42 slide relative to one another, with the bottom plate 62 functioning to regulate the extend to which, if it all, any of the apertures 43 in the top plate are blocked.

Figure 6:
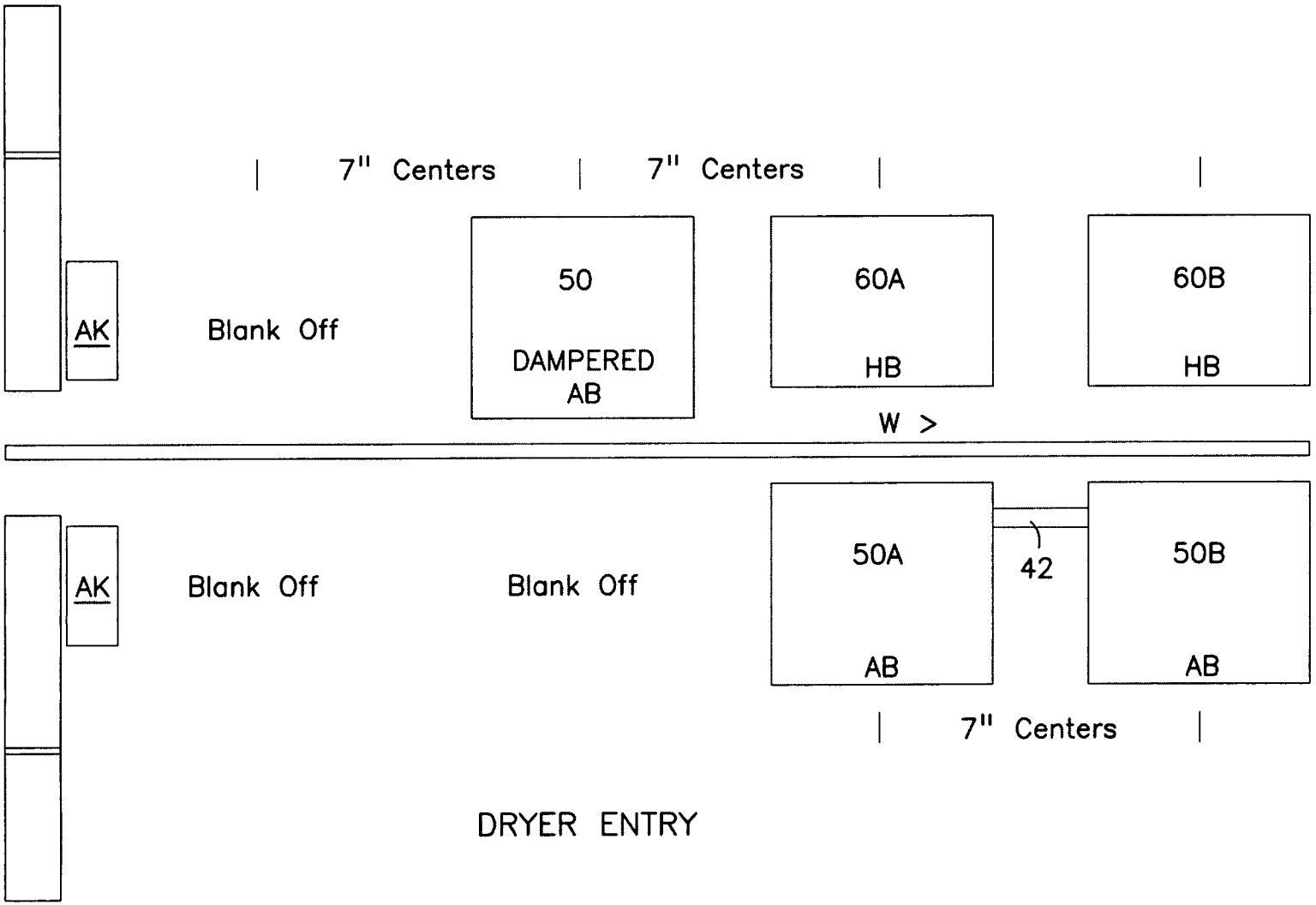
FIG. 6 is a schematic view of nozzle arrangement in a dryer entry section in accordance with certain embodiments.

A suitable dryer entry section arrangement of nozzles is shown in FIG. 6. The dryer entry section is the first zone of the dryer, and is followed by the dryer section containing the air bar/hole bar arrangement discussed above. In the embodiment shown, respective air knives AK above and below the web W are the first upper and lower element of the dryer. Those skilled in the art are familiar with air knives; they are used to provide an air seal at the dryer to prevent a "belching" effect out of the dryer and a minimization of cold air into the dryer through the web slot. The design of the air knives that are used is not particularly limited. The dryer entry section also has an array of nozzles above the web W that includes a first dampered flotation nozzle 50 that is spaced from the upper air knife by a "blank off", which may include a return air plate or baffle with appropriate apertures. These help to balance the pressure in these open areas to allow for stable web flotation through this section prior to the first air bars. The first dampered flotation nozzle 50 is unopposed by a nozzle below the web (as indicated by "blank off"), and is followed by a first direct impingement nozzle 60A spaced from the dampered nozzle 50 by at least the distance necessary to accommodate another flotation nozzle (e.g., the center of the first direct impingement nozzle 60A is 14 inches from the center of dampered nozzle 50) and directly opposed by a flotation nozzle 50A, which in turn is followed by a second direct impingement nozzle 60B in the web direction that is also directly opposed by a flotation nozzle SOB below the web W. Preferably the air flotation nozzles 50A, 50B and the direct impingement nozzles 60A, 60B are positioned on 7-inch centers. Preferably the flotation nozzles 50A and 50B are paired nozzles with return air member 42 as shown. The dampered flotation nozzle 50 has independent air pressure control via a damper in the inlet to the nozzle. It always runs at less pressure than the remaining air bars to center the web in the web slot opening on the dryer. The dampered nozzle does not have an opposing hole bar so the pressure must be reduced to keep the web from floating too high off the dampered nozzle.

Figure 2:
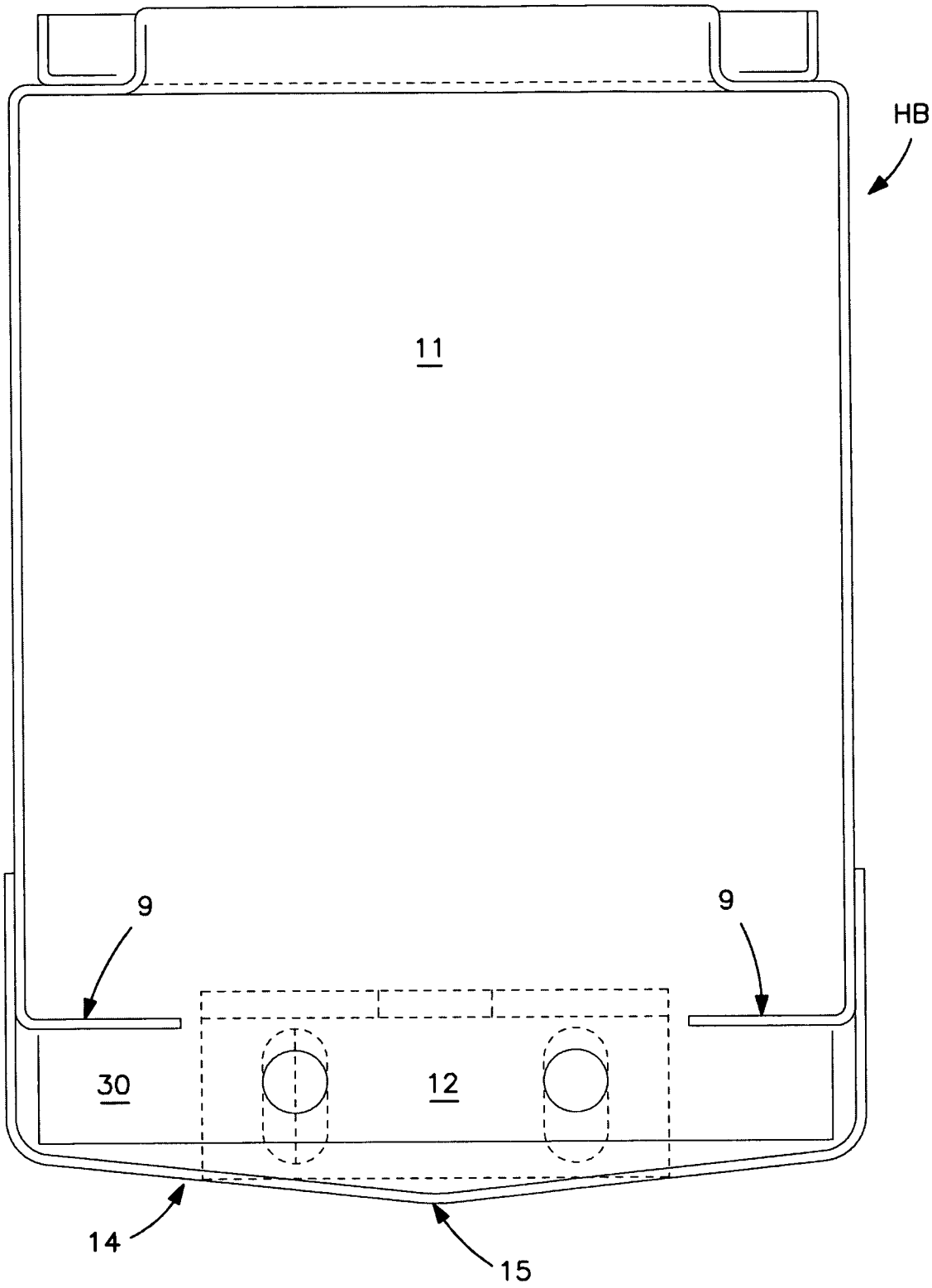
FIG. 2 is a cross-sectional view of a direct impingement nozzle in accordance with certain embodiments.
Figure 3:
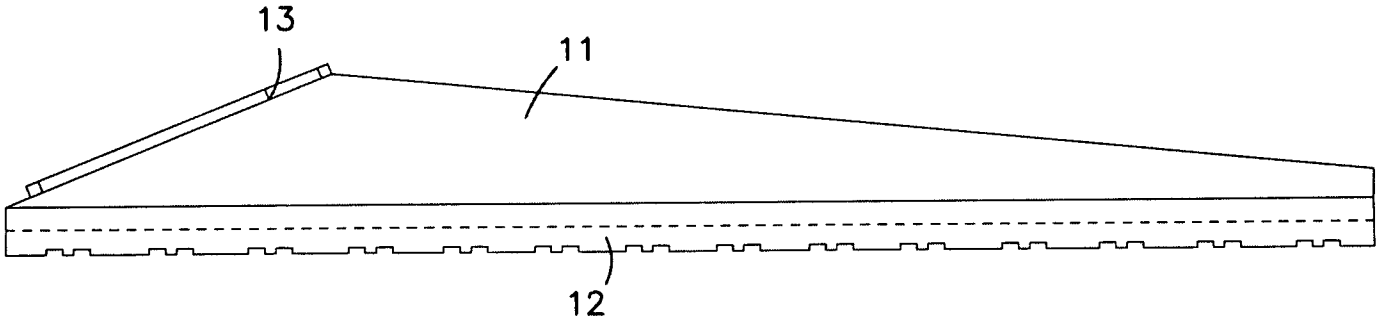
FIG. 3 is a side view of the bar of FIG. 2.

Turning now to FIGS. 2 and 3, a preferred embodiment of a direct impingement nozzle hole bar HB is shown. Hole bar HB is installed in air-receiving communication with a header 11 having a port 13. Header 11 feeds air into hole bar compartment 12. The air emits from the hole bar HB via a plurality of apertures, in this case spaced circular holes in the top surface 14 of the hole bar HB. Preferably the top surface 14 of hole bar is crown shaped and approaches a central apex 15 at about a 5 degree angle. This design encourages the return air to flow over the edges of the hole bar after impingement on the web W. A flatter top surface 14 tends to result in return air traveling down the face of the hole bar in the cross-web direction, which is undesirable. The angle of the crown can vary from about 0 degrees to about 10 degrees. In general, the closer the hole bar is to the web W, the larger the angle of the crown. Hole bars at a large distance from the web could be flat.

The particular pattern and configuration of apertures in the top surface 14 of the hole bar HB is not critical, as long as relatively uniform coverage of the web is provided, and the impingement of air is not directly over the center of the pressure pad generated by an opposing air bar. The percent open area of a hole bar or an air bar is defined by the following equation:

$$\left[\sum_{i=1}^{i} A_{sperfi} n_i\right] / A_{top} \times 100$$

Where:

j=number of perforation types $A_{sperf}$=cross-sectional area of a perforation type n=number of copies of a perforation type $A_{top}$=exterior surface area of hole or air bar top where perforations are located The percent open area of the hole bar HB is from 1.8 to about 7.5% of the total area of the hole bar, preferably about 2.4% of the total area of the hole bar. The total dryer effective open area is defined by the following equation:

$$\left[\sum_{i=1}^{i} (A_{openi})(n_i)(C_{di})\right] / A_{surface\ web\ based} \times 100$$

Where:

$A_{open}$=% open area/100×$A_{top}$ of bar type n=number of duplicates of a bar type j=number of bar types in dryer $C_d$=discharge coefficient of bar type $A_{surface}$ web heated=total surface area of web being heated The dryer effective open area can be based on measured or calculated discharge coefficients, and is preferably in the range of 1.4 to 4%, most preferably 1.5% of the total web surface area being heated in the dryer enclosure. In the embodiment shown in FIG. 4, the hole bar open area is accomplished with 8 horizontal rows 25*a*-25*h* of circular holes 18, each horizontal row of holes 18 consisting of 31 holes spaced at 1.83 inch intervals. It should be understood by those skilled in the art that the number of rows of holes and the number of holes per row can vary, depending in part upon the size of the hole bar for the application. In the embodiment shown, the top row 25*a* commences 0.488 inches from the side edge 20 of the hole bar, and 0.421 inches from the top and bottom edges 21*a* and 21*b*. Each subsequent horizontal row 25*b*-25*h* is spaced an additional 0.229 inches from the side edge 20. Each horizontal row 25*a*-25*h* is vertically spaced 0.454 inches from its neighboring row, except the rows nearest the center of the bar. In order to reduce web disturbance at close spacing to the web, it is preferred that the center of the hole bar be devoid of holes. Preferably the dimensions of this central portion devoid of holes is such that two symmetrical rows of holes could be accommodated therein if such holes were present.

Where the apertures of the hole bar are of a different configuration, such as diamonds, square or rectangular slots, preferably they have an equivalent diameter of from about 0.06 to 0.5 inches. Also, the slots can be continuous along the length of the bar.

Figure 4:
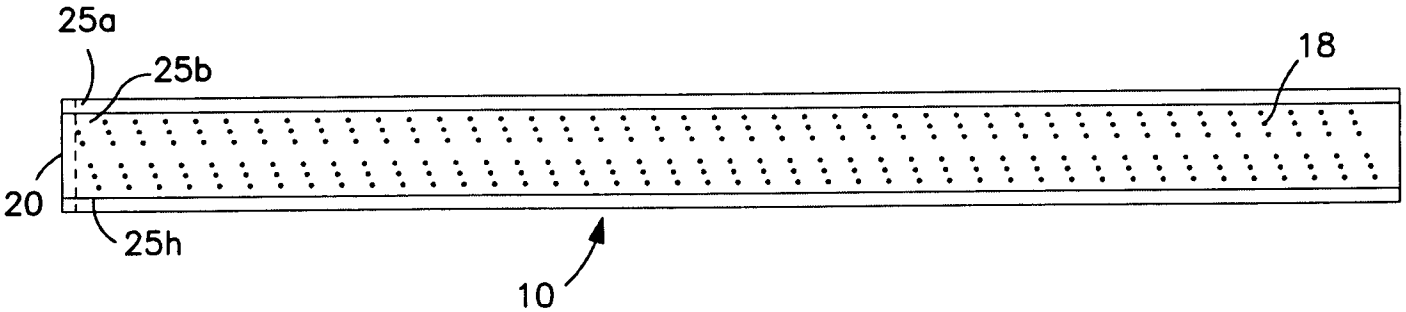
FIG. 4 is a top view of a direct impingement nozzle in accordance with certain embodiments.

Although an end feed hole bar is shown in FIG. 4, a center feed design can also be used, depending upon the application.

Depending upon the size of the holes 18, "whistling" and web fluting or wrinkling problems, particularly in the machine-direction, can arise. These problems should be minimized without compromising good flotation and heat transfer characteristics. Hole diameters of 0.164, 0.172 and 0.1875 inches result in minimal web fluting and whistling in graphic arts applications, with hole diameters of 0.1875 inches being especially preferred. The optional use of a hole bar diffuser plate (not shown) coupled to flanges 9 (FIG. 2) between the header 11 and the compartment 12 may also be used in reducing whistle. A flow straightener 30 may also be positioned in chamber 12 of hole bar HB to improve the air flow characteristics.

Also of importance in optimizing flotation and heat transfer characteristics is the height of the hole bars HB from the web W. If the hole bars are too close to the web centerline, web instability and web touch-down on the air bar top can occur. However, moving the hole bars too far away from the web centerline can cause an undesirable loss in heat transfer. Accordingly, preferably the hole bar should be from about 2 to about 10 equivalent aperture diameters (or slot widths) away from the web. Actual hole bar clearances ranging from about ⅛ to 1¾ inches from the web are preferred.

Suitable nozzle velocity is in the range of 1000 to 12000 feet per minute, with a nozzle velocity of from about 8000 to 10000 fpm being preferred.

The flotation nozzles and direct impingement nozzles need not be fed by the same header systems; separate headers can be used, especially if different operating velocities and/or air temperatures in the direct impingement nozzles and flotation nozzles are desired. Independent control of velocities may be important where heat transfer and flotation requirements are at odds, such as where low web tensions require reduced flotation velocity, yet the heat transfer required remains the same.

Similarly, the air bars and hole bars can be separately dampered such that they operate at different nozzle velocities.

What is claimed is:

1. Apparatus for floatingly drying a running web, said apparatus comprising: first and second opposed arrays of nozzles for floatingly supporting and drying a web running therebetween, each array comprising a plurality of direct impingement nozzles and a plurality of air flotation nozzles, said direct impingement nozzles being arranged in pairs, alternating with pairs of said flotation nozzles, and each said pair of direct impingement nozzles opposing a pair of flotation nozzles, wherein each of said direct impingement nozzles has a plurality of apertures that create direct air impingement on said web, and each of said flotation nozzles comprises a plurality of slots and a spacing between said slots which exhibit the Coanda effect.

2. The apparatus of claim 1, wherein each pair of flotation nozzles comprises a perforated member between each nozzle of said pair.

3. Apparatus for floatingly drying a running web in a web path, said apparatus comprising: a first array of nozzles positioned above said web path and comprising, in combination, a first pair of flotation nozzles for floatingly supporting said web, each of said flotation nozzles comprising a plurality of slots and a spacing between said slots which exhibit the Coanda effect, said flotation nozzles followed by, in the direction of travel of said running web, a first pair of direct impingement impingement nozzles for drying said web, each of said direct impingement nozzles having a plurality of apertures that create direct air impingement on said web, and a second array of nozzles positioned below said web path and comprising, in combination, a second pair of direct impingement nozzles for drying said web, each of said direct impingement nozzles in said second pair having a plurality of apertures that create direct air impingement on said web, followed by, in the direction of travel of said running web, a second pair of flotation nozzles for floatingly supporting said web, each of said flotation nozzles in said second pair comprising a plurality of slots and a spacing between said slots which exhibit the Coanda effect, each said pair of direct impingement nozzles opposing each said pair of flotation nozzles, and wherein between each flotation nozzle of each said pair of flotation nozzles is a return air control member having a plurality of apertures for directing return air from said flotation nozzles.

4. The apparatus of claim 3, wherein each direct impingement nozzles within said first and second pairs comprises a top surface having a plurality of apertures representing a total open area of from 1.8 to about 7.5% of the total area of said top surface, and having a height/diameter ratio of from greater than 3 to about 10.

5. The apparatus of claim 4, wherein said height/diameter ratio is 4:7.

6. The apparatus of claim 4, wherein the equivalent diameter of each of said plurality of apertures is from 1/16 to 1/2 inches.

7. The apparatus of claim 3 further comprising a dryer enclosure housing said first and second arrays of nozzles, and wherein said dryer has effective open area of from 1.4 to about 4%.

8. The apparatus of claim 3, wherein each flotation nozzle within each said first and second pairs of flotation nozzles is spaced about 7 inches from the other of said flotation nozzles within said respective pair.

9. The apparatus of claim 3, wherein said return air control member comprises a flat plate, and wherein the size of the openings of said plurality of apertures allowing return air through is variable.

10. The apparatus of claim 3, wherein said first and second arrays each comprise multiple pairs of direct impingement nozzles and multiple pairs of flotation nozzles, and wherein each of said pairs of direct impingement nozzles alternate with pairs of said flotation nozzles.

11. A method of floatingly drying a running web, comprising:

providing a web dryer enclosure having a web inlet slot and a web outlet slot;

floatingly guiding said running web in said dryer enclosure with first and second opposed arrays of nozzles for floatingly supporting and drying said web, each array comprising a pair of air flotation nozzles followed by a pair of direct impingement nozzles in the direction of web travel, each said pair of direct impingement nozzles in said first array opposing said pair of flotation nozzles in said second array, and wherein between each flotation nozzle within said pair of flotation nozzles, providing a member having a plurality of apertures for directing return air from said flotation nozzles, each of said flotation nozzles comprising a plurality of slots and a spacing between said slots which exhibit the Coanda effect, and each of said direct impingement nozzles having a plurality of apertures that create direct air impingement on said web.

* * * * *